US005728012A

United States Patent [19]

Boelling

[11] Patent Number: 5,728,012

[45] Date of Patent: Mar. 17, 1998

[54] GOLF BALL TEE SETTING DEVICE AND METHOD OF USING SAME

[75] Inventor: James E. Boelling, Ankeny, Iowa

[73] Assignee: Wy-Tech, Inc., Des Moines, Iowa

[21] Appl. No.: 810,627

[22] Filed: Feb. 28, 1997

[51] Int. Cl.[6] ..... A63B 57/00

[52] U.S. Cl. ..... 473/386

[58] Field of Search ..... 473/386, 387, 473/398, 400, 406, 408, 132

[56] References Cited

U.S. PATENT DOCUMENTS

| | | | |
|---|---|---|---|
| D. 293,261 | 12/1987 | Sadowski . | |
| D. 314,922 | 2/1991 | Musillo . | |
| D. 321,544 | 11/1991 | Axne . | |
| D. 344,779 | 3/1994 | Axne . | |
| D. 347,255 | 5/1994 | Kerr et al. . | |
| D. 348,402 | 7/1994 | McDonald . | |
| D. 348,500 | 7/1994 | Mortenson et al. . | |
| D. 353,645 | 12/1994 | Robidoux et al. . | |
| D. 361,815 | 8/1995 | Fazekas . | |
| 2,801,852 | 8/1957 | Hottle | 473/386 |
| 3,074,719 | 1/1963 | McKee . | |
| 3,312,468 | 4/1967 | Lynch . | |
| 3,333,848 | 8/1967 | Budzinski . | |
| 3,633,919 | 1/1972 | Liccardello . | |
| 3,658,331 | 4/1972 | Driscoll | 473/386 |
| 4,660,837 | 4/1987 | Bressie | 473/386 |
| 4,896,883 | 1/1990 | Wagenknecht . | |
| 4,960,239 | 10/1990 | Wait | 473/406 |
| 4,982,510 | 1/1991 | Musillo | 473/386 |
| 5,242,161 | 9/1993 | Wilkirson . | |
| 5,401,019 | 3/1995 | Wissman et al. | 473/406 |
| 5,634,862 | 6/1997 | Gamacha | 473/386 |

*Primary Examiner*—Steven B. Wong

*Attorney, Agent, or Firm*—Zarley, McKee, Thomte, Voorhees & Sease

[57] ABSTRACT

A golf ball tee setting device holds a tee at its bottom end and has opposite side edges which extend upwardly and outwardly and merge into upwardly and outwardly extending shoulders for engaging the top edge of the striking face of different golf club heads. The side edges of the device extend at angles to the vertical corresponding to the angles of the club head faces, with one side edge matching up with 1-2-3 woods and the opposite side edge corresponding to 4-5 woods.

10 Claims, 4 Drawing Sheets

GOLF BALL TEE SETTING DEVICE AND METHOD OF USING SAME

BACKGROUND OF THE INVENTION

It is generally agreed that the preferred height of a golf ball on a tee is such that the horizontal center line of the golf ball is at the same height as the top edge of the striking face of the golf club head at rest on the ground. Different club heads have different heights and thus the golf ball must be raised or lowered accordingly. As an example, the golf ball to be driven by a 1 wood club head will be set higher than its height if the ball is to be driven by a 5 wood.

The golf ball setting procedure typically involves placing the ball on the tee, using the ball to press the tee into the ground a distance estimated to be appropriate for the 1-2-3-4 or 5 wood club being used.

There are golf ball tee setting devices available which function by engaging the ground for setting the height of the tee. The tee will be placed in the device such that the tee extends from the device a distance appropriate for the ball height desired. The bottom end of the golf ball setting device engages the ground and fixes the height of the tee. These devices do not factor in the variety of makes, models and styles of club heads commonly in use by golfers today.

SUMMARY OF THE INVENTION

The golf ball tee setting device of this invention does not engage the ground for fixing the height of the tee when inserted into the ground, but instead engages the top edge of the striking face of the head of the golf club to be used, regardless of the style or brand of golf club. The relationship of the tee head to the tee setting device is fixed at one-half of the diameter of a standard golf ball, and thus the height of the tee is always the same relative to the club head regardless of which club is used. The top edge of the striking face of the club head itself functions as the gauge, thereby eliminating any guess work in determining how high the tee should be set for a given club.

The golf ball tee setting device has a unitary body member with opposite side edges which extend at different angles to the vertical center line, such that the side edges will matingly engage the top edge of the club head striking faces having different heights and different angles relative to the vertical center line of the golf tee. The opposite side edges of the tee setting device extend upwardly and outwardly and merge into upwardly and outwardly extending shoulders which matingly engage the top side of a golf club head.

The tee setting device has front and back recessed sides for receiving a ball marker to present a substantially smooth exterior. A cleaning hole for scraping dirt and debris from the shaft of a golf tee also extends through the device in the recess accessible from either side.

The method of using the tee setting device includes first selecting the club to be used and then orienting the tee setting device with tee inserted in recess 44 and the appropriate side edge adapted to engage the selected club head striking face. A tee head is positioned in the golf ball setting device, with the device being used to press the tee into the ground until the side edge shoulder engages the top edge of the striking face of the club head resting on the ground. This procedure will result in the golf ball, when placed on the tee, always being at the proper height for the club being used. It is understood that the club head during the forward swing rises off the ground such that at moment of impact with a ball, the ball is squarely in the center of the striking face.

DETAILED DESCRIPTION OF THE INVENTION

Figure 1:
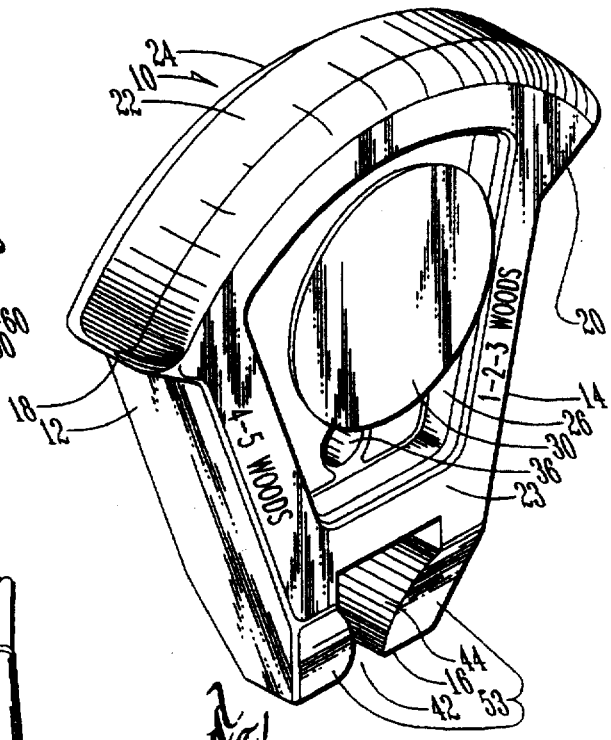
FIG. 1 is a perspective view of the golf ball tee setting device.

The golf ball tee setting device of this invention is referred to generally in FIG. 1 by the Reference 10.

The tee setting device 10 includes a unitary body having opposite side edges 12 and 14 which extend upwardly and outwardly from a bottom end 16 and merge into upwardly and outwardly extending shoulders 18 and 20. A top convex end edge 22 interconnects the shoulders 18 and 20.

Figure 8:
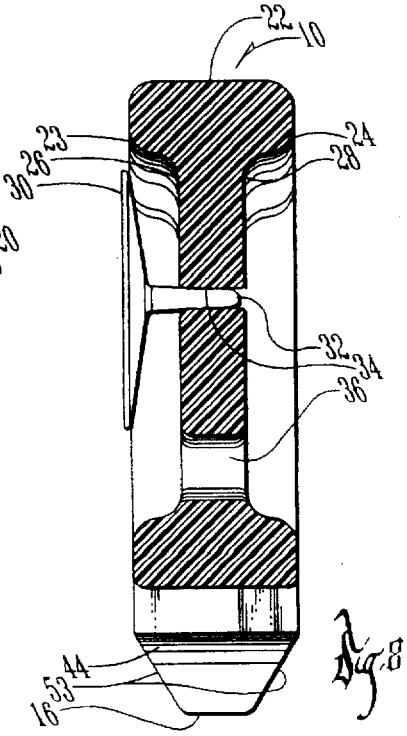
FIG. 8 is a cross-sectional view taken along line 8—8 in FIG. 7.

The tee setting device 10 also includes front and rear sides 23 and 24 each having recesses 26 and 28 for receiving a ball marker 30 to present a substantially smooth exterior as seen in FIG. 8. The ball marker 30 has a stem 32 received in a hole 34 extending through the front and back recesses 26 and 28. A tee cleaning hole 36 is also provided for receiving from either side the stem 38 of a tee 40 for cleaning dirt and grass clippings.

The lower end 16 of the tee setting device 10 includes a throat 42 extending into a tee head recess 44 open to the front and back sides of the tee setting device. Thus it is seen that a tee head 46 may be inserted from either side of the device 10 into the recess 44 with the tee stem 38 being received in the throat 42.

Figure 7:
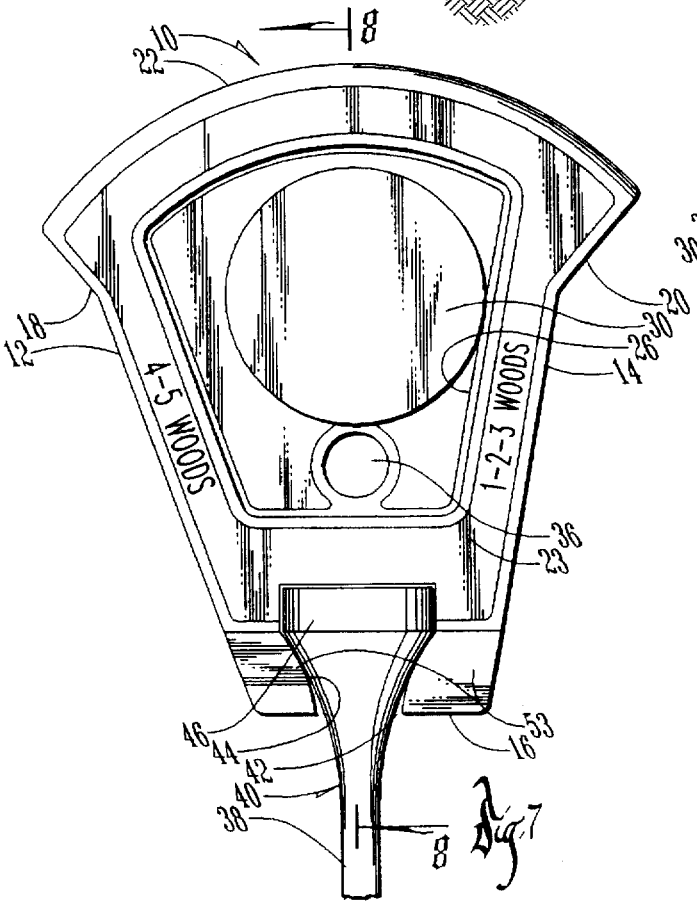
FIG. 7 is an enlarged side elevational view of the golf ball tee setting device in combination with a tee.
Figure 9:
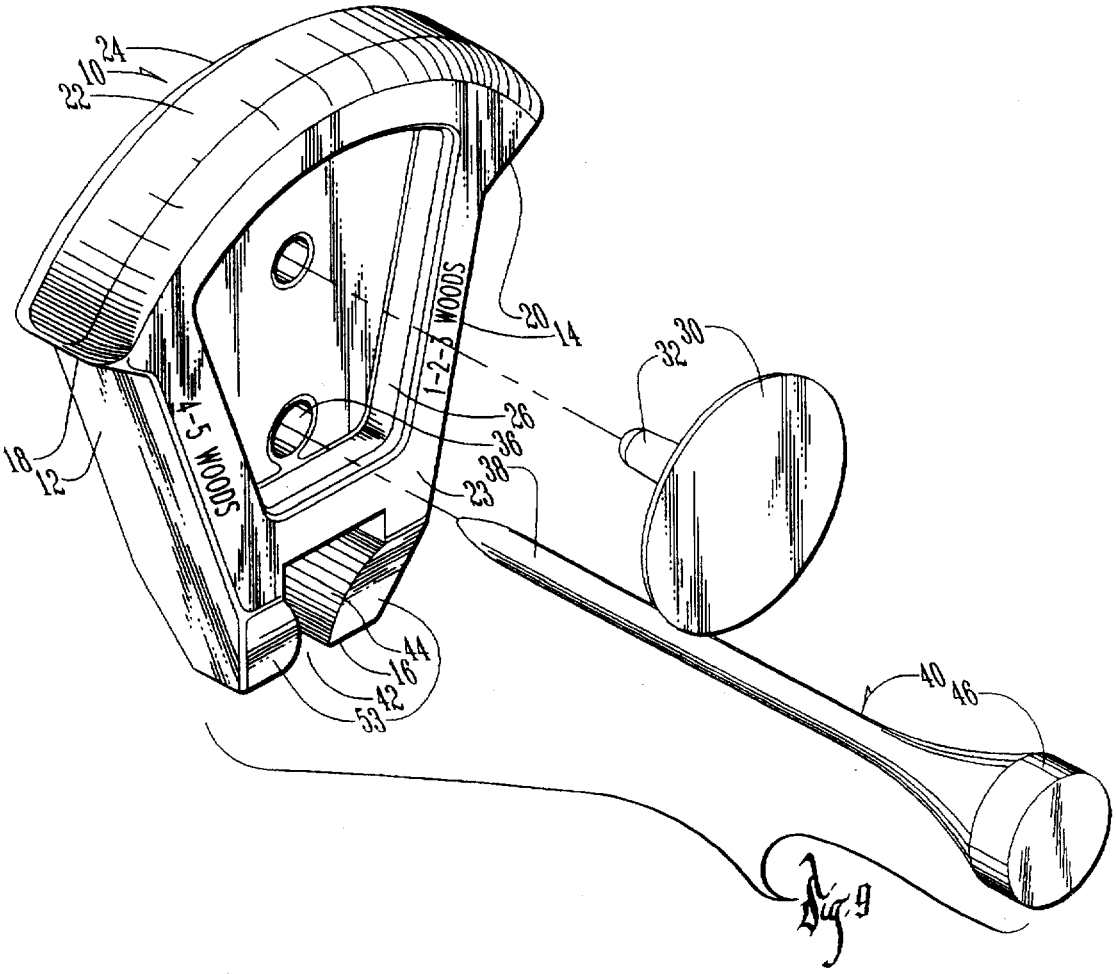
FIG. 9 is an enlarged exploded perspective view of the golf ball tee setting device in combination with a ball marker and tee to be cleaned in a hole extending through the device.

As seen in FIGS. 1, 7 and 9, the front side of the tee setting device is marked adjacent the opposite side edges with the notice "4-5 woods" on the left side and "1-2-3 woods" on the right side. The angle of the face of the edge 12 is 20° corresponding to the club head faces for 4-5 woods and 10° for the side edge 14 corresponding to 1-2-3 woods. The angles of the shoulders 18 and 20 correspond to the top edges of the striking faces of corresponding club heads.

Figure 4:
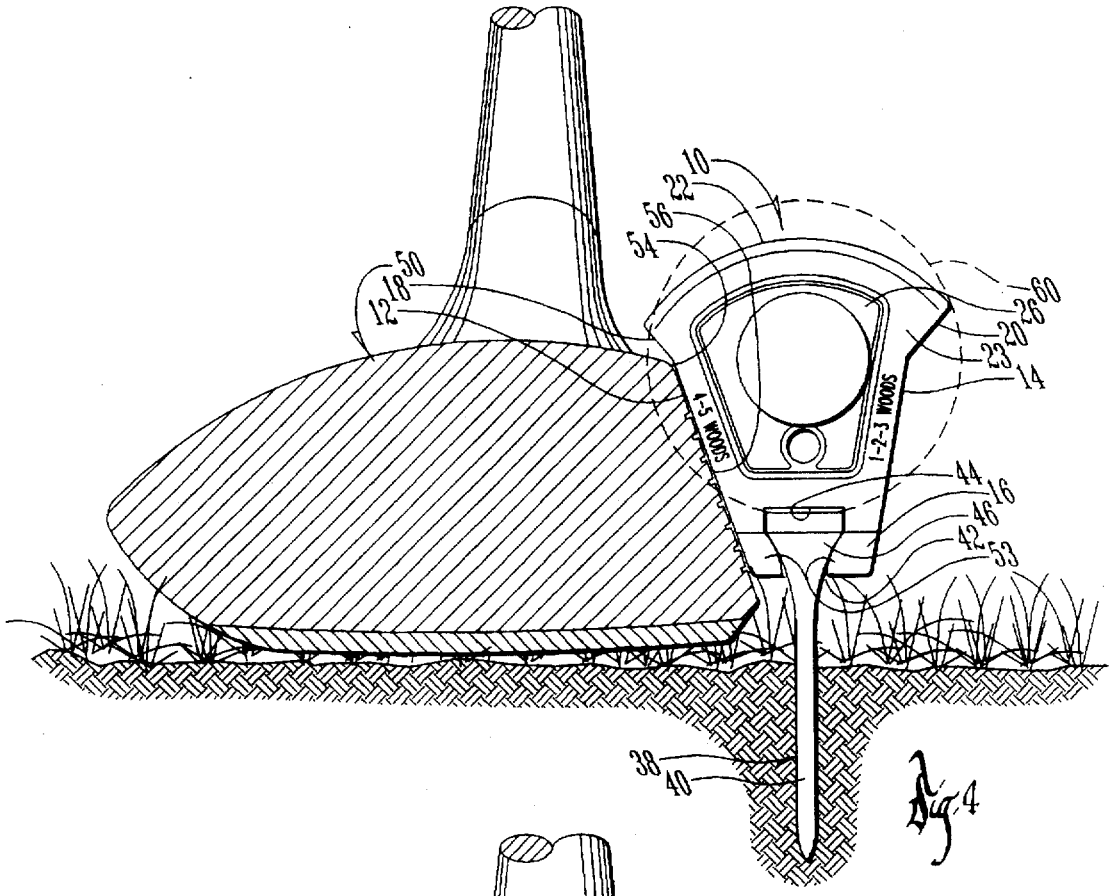
FIG. 4 is an elevational cross-sectional view of a 4 or 5 wood club being used as a gauge for setting a golf tee in the ground.
Figure 5:
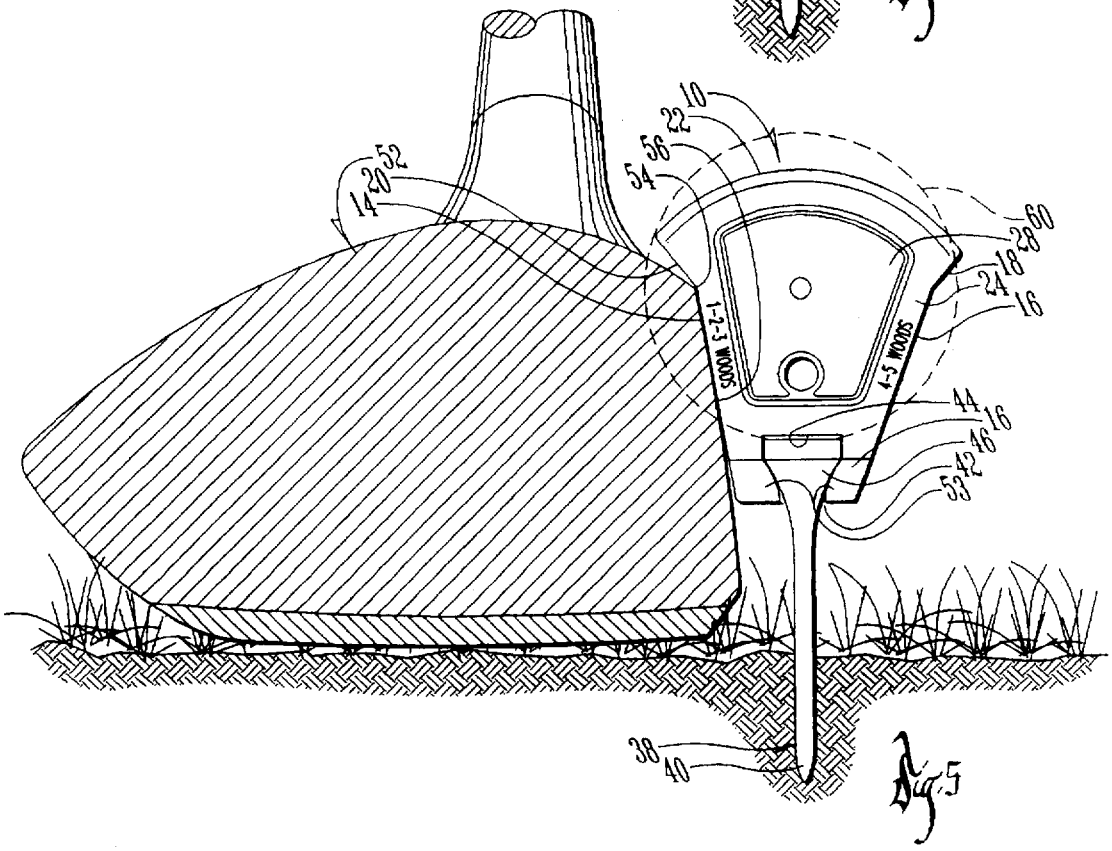
FIG. 5 is a view similar to FIG. 4 but showing a 1, 2 or 3 wood club being used as a gauge.
Figure 6:
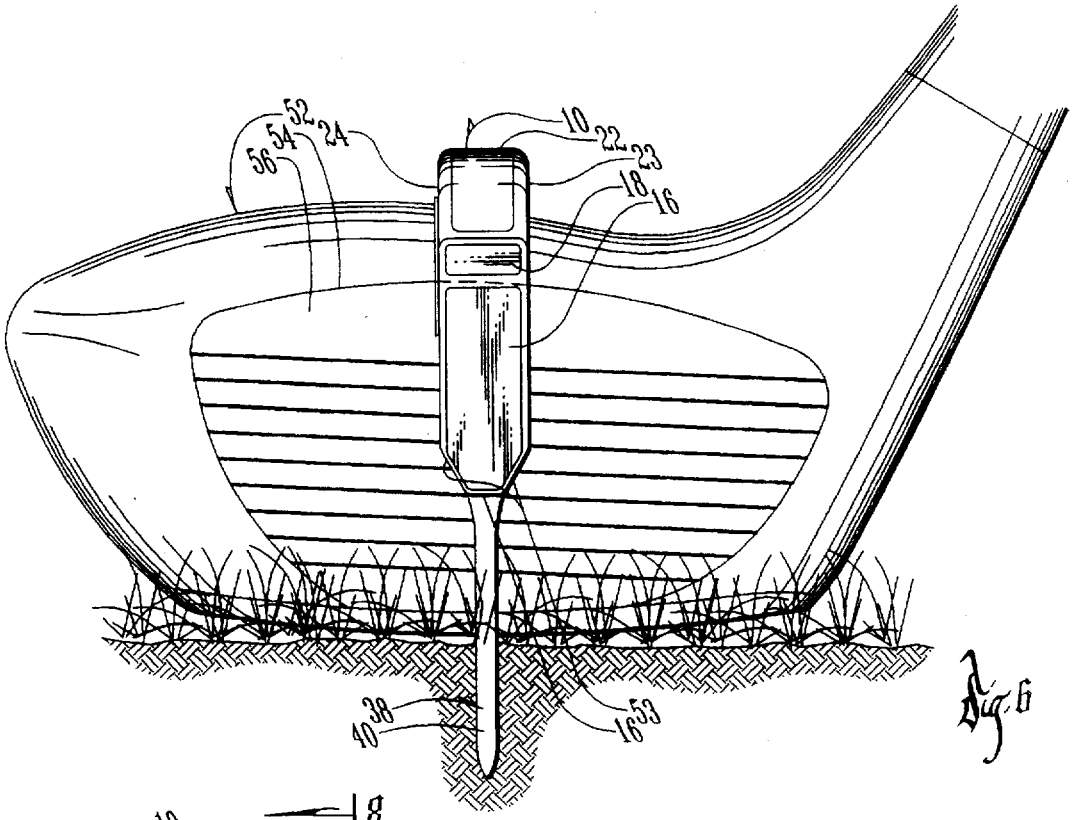
FIG. 6 is a view similar to FIGS. 4 and 5 but showing the club head and tee setting device from the front side of the club striking face.

In FIG. 4 it is seen that a 4-5 wood 50 matches up with the side edge 12 of the tee setting device 10 and in FIG. 5 a 1-2-3 wood 52 matches up with a side edge 14.

As seen in FIGS. 7 and 8, the lower end 16 includes four tapered side surfaces 53 to conform to the shape of the top end of the golf tee head 46, making it easier to grip the tee in the device 10. This is particularly important to golfers with minimized dexterity and accommodates the infinite sizes of male and female hands.

In use, the club is first selected and then the ball tee setting device 10 is oriented such that the appropriate side edge 12 or 14 is facing the club head striking face when the club head is placed on the ground. A tee head 46 is positioned in the recess 44 and the device 10 is pressed downwardly forcing the tee stem 38 into the ground until the appropriate shoulder 18 or 20 engages the top edge 54 of the striking face 56 of the club head 50 or 52 as seen in FIGS. 4 and 5. Matching the correct side edge of the device 10 with the slope of club head face assures that tee stem 38 is inserted into the ground vertically straight and that the shoulders 18 and 20 engage the top edge 54 of the striking face 56. It is thus seen that the use of the tee setting device 10 of this invention always assures, without any guess work, that the tee and the ball will always be at the right height for the club being used, whether the clubs are right or left hand clubs.

Figure 2:
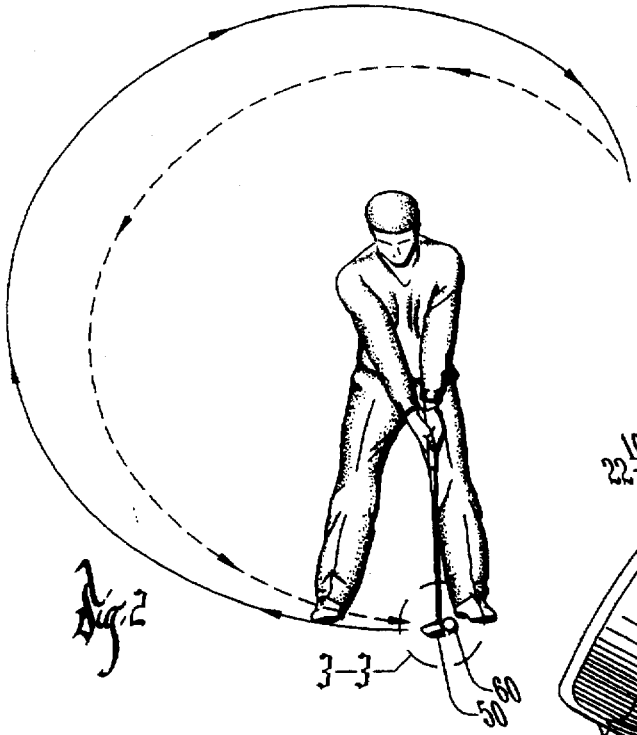
FIG. 2 is a view of a ball on a tee being addressed by a golfer showing the trajectory of the golfer's back swing and forward swing.
Figure 3:
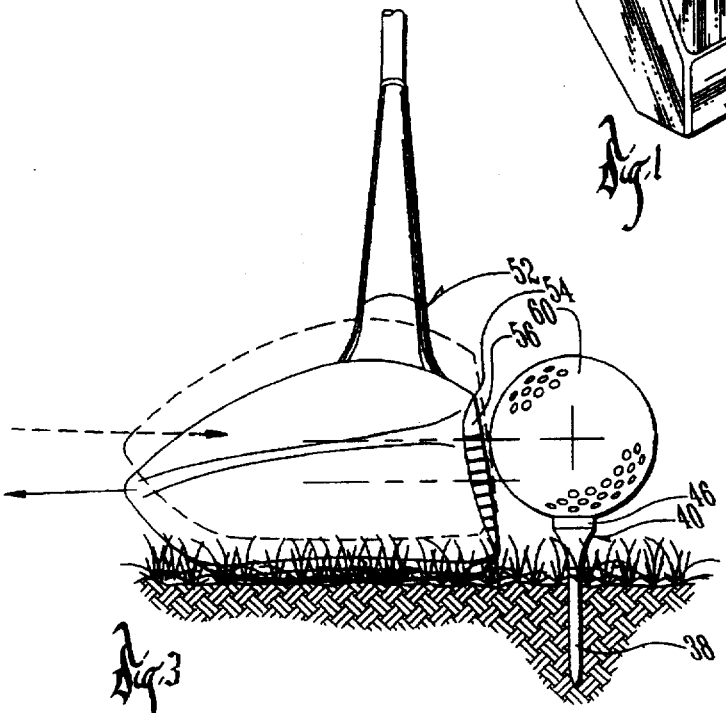
FIG. 3 is an enlarged front end elevational view as indicated by the line 3—3 in FIG. 2 of the club head relative to the ball on a tee at the time the club head starts its back swing trajectory and in dash lines when it returns for hitting engagement with the ball.

FIGS. 2 and 3 illustrate the change in height of the club head relative to the ground during the back swing and forward swing. It is seen that the club head rises above the ground a short distance during the forward swing and impact with the ball 60 such that the ball engages the sweet spot center of the club head stiking face.

What is claimed is:

1. A golf ball tee setting device comprising, a unitary body member having opposite side edges, front and back sides and top and bottom ends, said bottom end having a downwardly opening tee head recess, one of said opposite side edges at its upper end merging into an upwardly and outwardly extending shoulder for mating engagement with a top edge of the striking face of a golf club head to set a tee head vertically straight and at the desired height above the ground, and said one side edge having a face in a plane extending upwardly and outwardly at an angle to a vertical center line which is substantially equal to the angle of a golf club face to the vertical.

2. The golf ball tee setting device of claim 1 wherein said front side is recessed and includes a transversely extending hole to receive a ball marker positioned substantially within said recess.

3. The golf ball tee setting device of claim 1 wherein said body includes a second hole which extends laterally through said recess for receiving and cleaning tee stems.

4. The golf ball tee setting device of claim 1 wherein said front and back sides are recessed and include a transversely extending hole to receive a ball marker substantially within said recess.

5. The golf ball tee setting device of claim 1 wherein said other side edge merges at its upper end into an upwardly and outwardly extending shoulder, said other side edge having a face in a plane extending upwardly and outwardly at an angle to a vertical center line which is substantially equal to the angle of a golf club face to the vertical with the angles of the planes of said opposite edges being different for said side edge faces to substantially matingly engage different golf club head faces having different heights whereby the height of the golf ball varies with the height of the golf club head striking face.

6. The method of setting a golf ball tee comprising, providing a golf ball tee setting device including a unitary body member having opposite side edges, and top and bottom ends, said bottom end having a tee holding means, said opposite side edges extending upwardly and outwardly at different angles to a vertical center line and merging at their top ends into upwardly and outwardly extending shoulders for mating engagement with the striking faces and the top edges of different golf club heads, attaching a ball tee to said tee holding means, selecting a golf club to be used, selecting the side edge of the golf ball tee setting device corresponding to the golf club selected, placing the selected golf club head on the ground with the golf ball tee setting device oriented with the selected side edge and shoulder of the device adapted for engaging the striking face and its top edge of the selected golf club head, and pressing downwardly on said device for inserting said tee into the ground until said shoulder engages the top edge of the striking face of the club head thereby setting the tee at the proper height and vertical alignment for a ball to be hit by the selected golf club wherein at rest the horizontal center line of the golf ball substantially corresponds to the top edge of the striking face of the selected club.

7. The method of setting a golf ball tee comprising, providing a golf ball tee setting device including a tee holding means and a golf club head engaging means, attaching a ball tee to said tee holding means, selecting a golf club to be used, placing the selected golf club head on the ground with the golf ball tee setting device oriented with a portion of the club head engaging means over the top side of the club head, and pressing downwardly on said device for inserting said tee into the ground until said club head engaging means engages the club head thereby setting the tee at the proper height for a ball to be hit by the selected golf club wherein at rest the horizontal center line of the golf ball substantially corresponds to the top edge of the striking face of the selected club.

8. A golf ball tee setting device comprising, a unitary body member having opposite side edges, front and back sides and top and bottom ends, said bottom end having a downwardly opening tee head recess, one of said opposite side edges at its upper end merging into an upwardly and outwardly extending shoulder for mating engagement with a top edge of the striking face of a golf club head to set a tee head vertically straight and at the desired height above the ground, and said tee head recess being open for access by a tee on both front and back sides of said unitary body member.

9. A golf ball tee setting device comprising, a unitary body member having opposite side edges, front and back sides and top and bottom ends, said bottom end having a downwardly opening tee head recess, one of said opposite side edges at its upper end merging into an upwardly and outwardly extending shoulder for mating engagement with a top edge of the striking face of a golf club head to set a tee head vertically straight and at the desired height above the ground, and said opposite side edges having faces in planes extending upwardly and outwardly at different angles to a vertical center line which are substantially equal to the angles of different golf club faces to the vertical.

10. A golf ball tee setting device comprising, a unitary body member having opposite side edges, front and back sides and top and bottom ends, said bottom end having a downwardly opening tee head recess, one of said opposite side edges at its upper end merging into an upwardly and outwardly extending shoulder for mating engagement with a top edge of the striking face of a golf club head to set a tee head vertically straight and at the desired height above the ground, and said bottom end on front and back sides and on either side of said tee head recess being tapered to conform to the shape of the top end of a golf tee head.

* * * * *